United States Patent [19]

Shoptaugh

[11] 4,239,230

[45] Dec. 16, 1980

[54] PEG BOARD GAME

[76] Inventor: Philip L. Shoptaugh, 611 Blair Ave., Piedmont, Calif. 94611

[21] Appl. No.: 974,167

[22] Filed: Dec. 28, 1978

[51] Int. Cl.[3] ..... A63F 3/00

[52] U.S. Cl. ..... 273/264; 273/271; 273/282; 273/290

[58] Field of Search ..... 273/264, 271, 290, 282

[56] References Cited

U.S. PATENT DOCUMENTS

| | | | |
|---|---|---|---|
| 1,714,792 | 5/1929 | Kurihara . | |
| 2,766,987 | 10/1956 | Seelbrede et al. . | |
| 2,896,950 | 7/1959 | Rosti et al. . | |
| 3,347,550 | 10/1967 | Carboni . | |
| 3,506,268 | 4/1970 | Stadler | 273/290 X |
| 3,558,137 | 1/1971 | Progin | 273/290 X |
| 3,561,774 | 2/1971 | Brinser | 273/241 |
| 3,747,926 | 7/1973 | Odom | 273/271 |

FOREIGN PATENT DOCUMENTS 1045456 11/1951 France .

1270021 7/1960 France .

*Primary Examiner*—Anton O. Oechsle

*Attorney, Agent, or Firm*—Phillips, Moore, Weissenberger, Lempio & Majestic

[57] ABSTRACT

A board game is disclosed which includes a plurality of each of three different kinds of playing pieces and a board having playing fields thereon adapted to receive each kind of playing piece. Two of the kinds of playing pieces are adapted to be played simultaneously on any playing field and to be moved independently of each other to other playing fields. The third kind of playing piece is adapted to block the playing of at least one of the other two kinds of playing pieces and to be blocked by such kind of playing pieces depending upon which is played first on a given playing field. Two of the three kinds of playing pieces preferably have the same exterior shape and dimensions. Additional kinds of playing pieces having various blocking and non-blocking relationships to the other kinds of playing pieces on the playing fields of an appropriate board are described.

13 Claims, 18 Drawing Figures

PEG BOARD GAME

DESCRIPTION

1. Technical Field

This invention relates to games and more particularly to a game which may be played by two or more people on a board having playing fields using at least three different kinds of playing pieces, two kinds of which may be played simultaneously and independently of each other on a given playing field and the third kind of which when played on a given playing field will block the playing of at least one of the other two kinds of playing pieces.

2. Background Art

In classic board games such as chess or checkers, no two playing pieces may occupy the same playing field at the same time whether the playing pieces are identical as in checkers, or of a plurality of different kinds as in chess. In checkers it is, of course, possible to stack the playing pieces on a given playing field and board games based on such stacking principle, whether the playing pieces are identical or of different kinds, are known, although it is noted that the playing pieces, once stacked, cannot be moved independently of each other.

Board games are also known in which a plurality of different kinds of playing pieces, adapted to nest or interfit with each other on a given playing field, are used. In such board games, the different kinds of playing pieces may be moved from one playing field to another independently of each other. However, the different kinds of such playing pieces are not inherently adapted to block each other from a given playing field.

The object of this invention is to provide a board game which is based on the interplay between blocking and non-blocking playing pieces at each of a plurality of playing fields on a game board.

DISCLOSURE OF THE INVENTION

According to this invention, a playing board having a plurality of playing fields is used in combination with a plurality of first playing pieces each having a cross-sectional configuration of given maximum external dimension, a plurality of second playing pieces which have an annular cross-sectional configuration dimensionsed to surround the given maximum external dimension of the cross-sectional configuration of each of the plurality of first playing pieces, and a plurality of third playing pieces each having a cross-sectional configuration different from the cross-sectional configurations of the first and second playing pieces dimensioned to overlap the cross-sectional configurations of at least said plurality of first playing pieces or said plurality of second playing pieces when aligned therewith. Thus, one of the plurality of first playing pieces and one of the plurality of second playing pieces may be played simultaneously with each other on any one of the playing fields of the playing board with the second playing piece surrounding the first playing piece and each may be moved independently of the other to another playing field while the playing of one of the plurality of third playing pieces on a given playing field will physically block the playing of at least the first or the second playing pieces on such given field.

BRIEF DESCRIPTION OF THE DRAWING

FIGS. 3*a*, 3*b* and 3*c* are perspective views of three different kinds of playing pieces, a plurality of each of which are used in combination with the playing board of FIGS. 1 and 2, according to a preferred embodiment of this invention.

FIGS. 10*a*, 10*b*, 10*c*, 10*d*, 10*e*, and 10*f* are enlarged perspective views of the playing pieces of FIGS. 8 and 9 which may be used according to this embodiment of the invention.

DETAILED DESCRIPTION OF PREFERRED EMBODIMENTS

Figure 1:
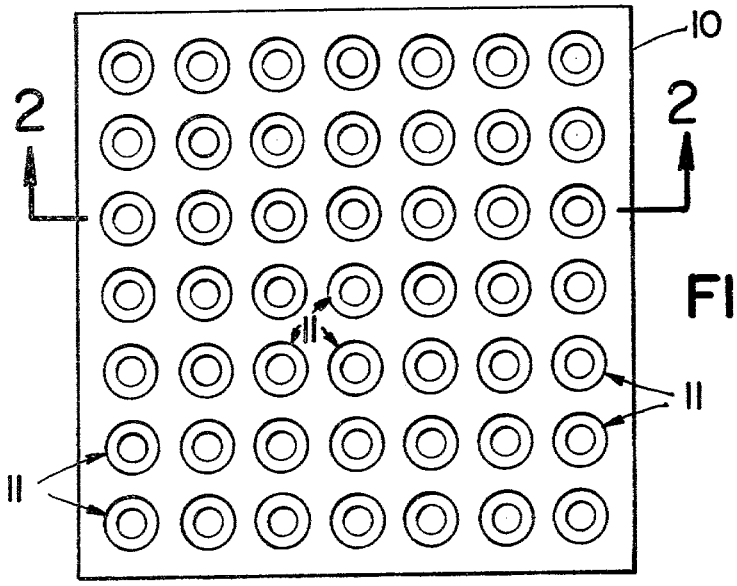
FIG. 1 is a top plan view of a playing board according to a preferred embodiment of this invention.

Referring to FIG. 1, a game board 10, suitable for use in a preferred embodiment of this invention, is shown. According to this embodiment, the game board 10 includes a 7×7 checkerboard array of playing fields 11. Such playing fields 11 may be conventional checkerboard squares or a plurality of circular or other shape areas aligned in rows and columns.

Figure 2:
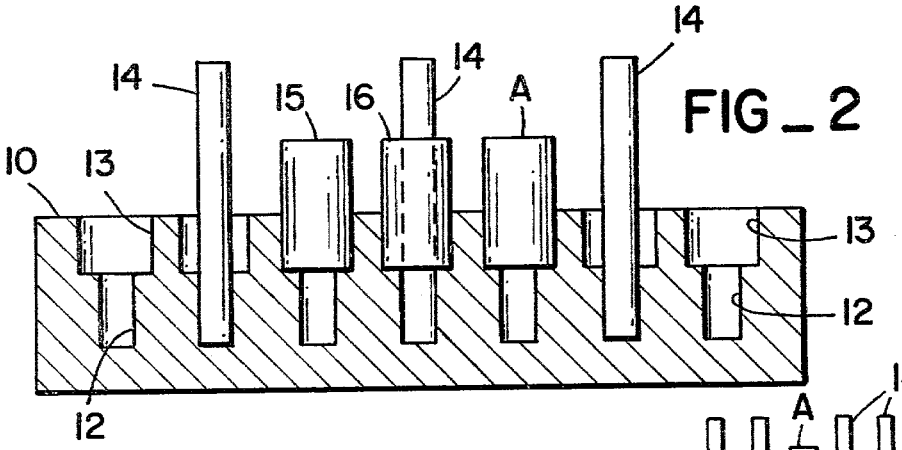
FIG. 2 is an enlarged cross-sectional view taken along lines 2—2 of FIG. 1, showing a winning combination of playing pieces in position on the playing board.

However, as best shown in FIG. 2, according to the preferred embodiment of this invention, the playing fields 11 each comprise a first cylindrical hole 12 of given diameter. The hole 12 is countersunk at one surface of the playing board 10 by means of a second cylindrical hole 13 of larger diameter.

Figure 3A:
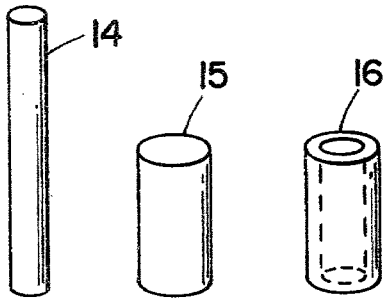
Figure 7:
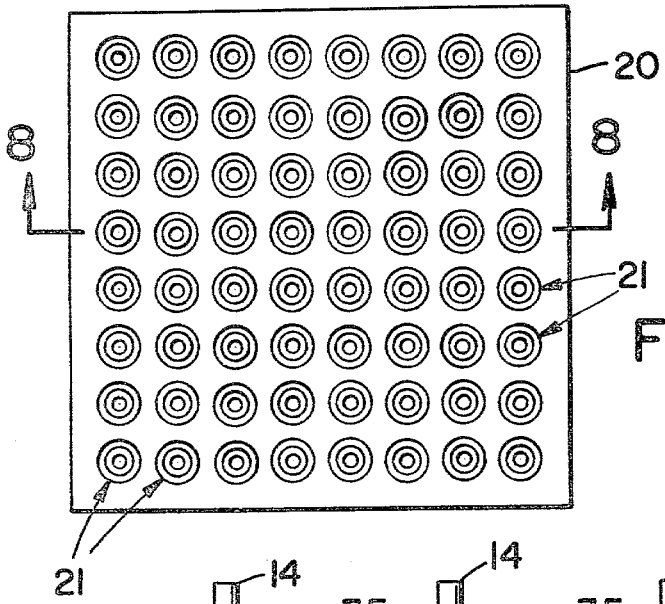
FIG. 7 is a top plan view of a playing board according to another preferred embodiment of this invention.

Referring to FIG. 3, the playing pieces for use in combination with each other and the playing board 10 are shown. According to this embodiment of the invention, three different kinds of playing pieces are used. Referring to FIG. 3*a*, the first kind of playing pieces is an elongated peg 14 dimensioned to be removably fit in the hole 12. Referring to FIG. 3*b*, the second kind of playing piece is a solid plug 15 which is shorter than the peg 14 and dimensioned to be removably fit in the hole 13 countersinking the hole 12 at one side of the playing board 10. Referring to FIG. 3*c*, the third kind of playing piece is an annular member or ring 16 having external dimensions which are substantially the same as the external dimensions of the plug 15 and having a passageway therethrough to freely receive the peg 14.

Referring again to FIG. 2, three pegs 14 are shown as received in the holes 12 of three playing fields 11 of the game board 10. Similarly, a plug 15 is shown as received in a hole 13 of a playing field 11 of the game board 10 and a ring 16 is shown received in a hole 13 about a peg 14 of a particular playing field 11 of the game board 10.

A further playing piece designated by the letter A in FIG. 2 is shown received in hole 13 of a playing field 11 of the game board 10. Such further playing piece A may be either a plug 15 or a ring 16.

The game according to the teaching of this invention may be played by two or more players and according to this invention, each player has a plurality of playing pieces of each of the three different kinds 14, 15 and 16. The playing pieces of each player will be a different color from the playing pieces of the other players or will bear some indicia capable of distinguishing the playing pieces of each player from the playing pieces of the other player or players. For simplicity in describing a preferred method of playing the game of this invention, it will be assumed that only two players are involved, each with playing pieces of different color from the playing pieces of the other.

Figure 4:
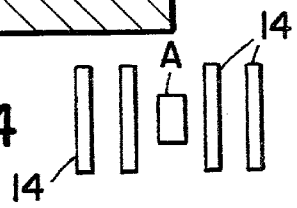
FIGS. 4, 5 and 6 are reduced side views in elevation, showing the playing pieces of FIGS. 3*a*, 3*b* and 3*c* in the various winning combinations thereof.
Figure 5:
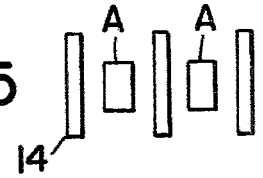
Figure 6:
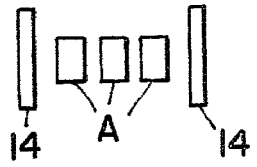

Referring to FIGS. 4, 5 and 6, the various winning combinations of playing pieces of a particular player according to one method of playing the game of this invention are shown. Thus, in order to win, a player must place five of his playing pieces on the game board 10 diagonally or in any row or column of the playing fields 11. Each winning combination must have a peg 14 at both extremes thereof. As shown in FIG. 4, a winning combination must include at least one playing piece A which may be either a plug 15 or a ring 16. Where only one playing piece A is used in the winning combination, it must be located centrally thereof.

As shown in FIG. 5, if two playing pieces A are used in the combination, they must be symmetrically located in order to provide a winning combination. Referring to FIG. 6, a winning combination may include three playing pieces A between the pegs 14 at the extremes thereof which three playing pieces A may comprise any combination of plugs 15 and rings 16.

Thus, referring again to FIG. 2, and assuming that the extreme right-hand peg 14 and the extreme left-hand peg 14 are playing pieces of a particular player, that particular player will have formed a winning combination unless the plug 15 or the playing piece A shown in FIG. 2 is a playing piece of another player. A non-obvious feature of this invention is that although a plug 15 provides a blocking function with respect to the playing of a peg or a ring 16, the playing of either a peg 14 or a ring 16 will block the playing of a plug and will simultaneously reserve a particular playing field. In other words, the playing of a peg 14 on a particular playing field will not only block the playing of a plug on that playing field but will also reserve that playing field for the subsequent play of a ring. Similarly, the playing of a ring on a particular playing field will not only block the subsequent play of a plug 15 on that playing field but will also reserve that playing field for the subsequent play of a peg 14.

Figure 11:
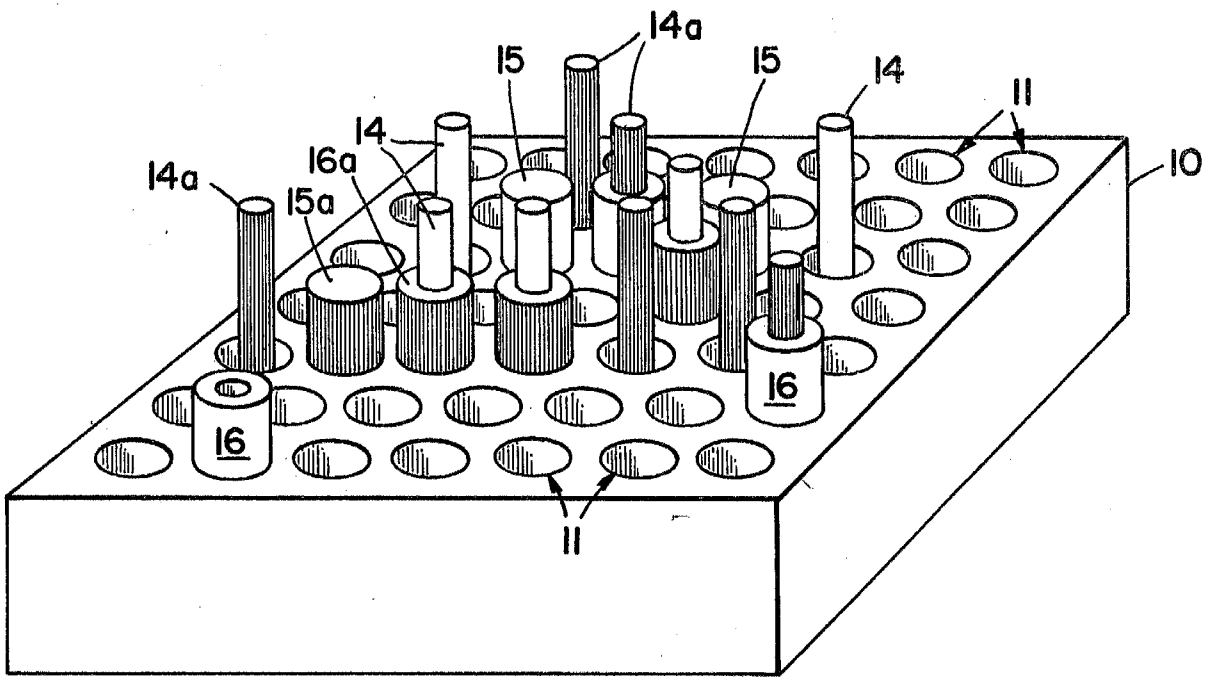
FIG. 11 is an enlarged perspective view of the playing board of FIG. 1, illustrating a method of play using the game board and playing pieces according to the embodiment of this invention shown in FIGS. 1–6.

The importance of the above feature will be more fully understood from the following description of a particular method of play of the game according to this invention in conjunction with FIG. 11. In the embodiment of this invention shown in FIG. 11, the playing fields 11 are arranged in seven rows extending from left to right and in seven columns extending from bottom to top of the Figure. A plurality of playing pieces 14, 15 and 16 of a first color are shown in FIG. 11 without shading and a plurality of playing pieces 14*a*, 15*a*, 16*a* of a second color are shown in FIG. A by the shading thereof. According to the rules of the method of play to be described in connection with FIG. 11, each player has nine pegs 14, 14*a*, three plugs 15, 15*a* and three rings 16, 16*a*. Play is begun with all playing fields 11 of the playing board 10 empty. One of the players then plays any one of his playing pieces at any playing field 11 of the board 10 which he chooses. The second player then plays one of his playing pieces and play continues alternately until one of the players forms a winning combination as described in connection with FIGS. 4, 5 and 6. A player may move a peg 14 from one playing field to another as soon as he has played all of his pegs 14 on the playing board 10. However, a player may not move a plug 15 or ring 16 from one playing field to another until he has played all of both his plugs 15 and rings 16 on the playing board 10. A player may not play both his own peg 14 and his own ring 16 at a particular playing field 11. However, a player may play his own peg at a playing field where a ring 16 of the other player is already present or one of his own rings 16 at a playing field 11 where a peg 14 of the other player is present. The above rules are not essential according to the teaching of this invention and interesting methods of play may be devised without such rules.

As shown in FIG. 11, two winning combinations of playing pieces are shown. Thus, in the third row from the bottom, a winning combination consisting of two pegs 14*a*, a plug 15*a* and two rings 16*a* therebetween is shown. Similarly, a diagonal winning array is shown beginning with the peg 14*a* located in the second row from the bottom and first column at the right, is shown. Such winning combination consists of four pegs 14*a* in two pairs with a ring 15*a* therebetween. It will be seen that the presence of pegs 14 of the other player's color in the winning arrays pointed out above will not block such winning combinations but may have, in fact, aided in their formation by reserving the playing field on which they were played for the subsequent play of the ring 16*a* of the opposing player.

Thus the interplay between the blocking, non-blocking and reserving functions of the playing pieces adds great interest to the play. It is extremely difficult for both players to play all of their playing pieces without allowing a winning combination to be formed, although it is possible to do so. Any subsequent play becomes even more exacting.

Figure 8:
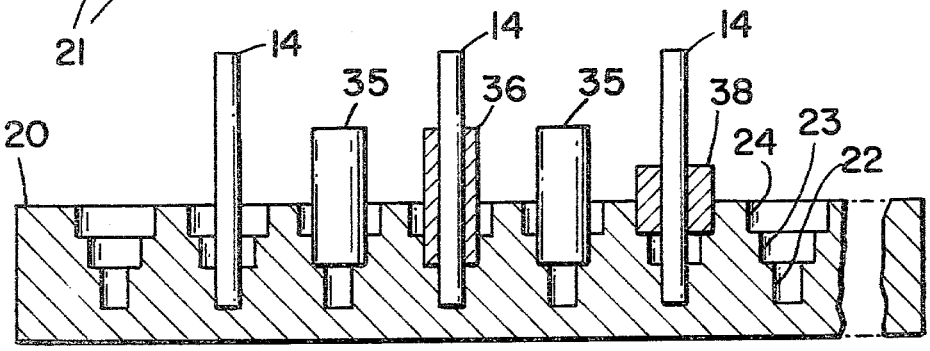
FIG. 8 is an enlarged cross-sectional view taken along lines 8—8 of FIG. 7, showing a first combination of playing pieces in position on the playing board.

The interplay between the various playing pieces will be more fully appreciated on consideration of the embodiment of this invention shown in FIGS. 7 through 10. According to this embodiment of the invention, six different kinds of playing pieces are used in combination with a playing board 20 having an $8 \times 8$ array of playing fields 21 in checkerboard array on one surface thereof. Again, the playing fields 21 on the playing board 20 may be a plurality of substantially identical areas of the surface of the playing board 20 in row and column array and may be circular, square, or of some other configuration. However, as shown in FIG. 8 each of the playing fields 21 preferably comprises a hole 22 of given diameter formed in the playing board 20 which hole 22 is countersunk from one surface of the playing board 20 by a second hole 23 of larger diameter than the first hole 22 and the second hole 23 is countersunk by a third hole 24 of still larger diameter from the same surface of the playing board 20. The holes 22, 23 and 24 preferably have circular cross-sections but may be of other appropriate cross-sectional configuration suitable for receiving the playing pieces in accordance with this invention.

Figure 10A:
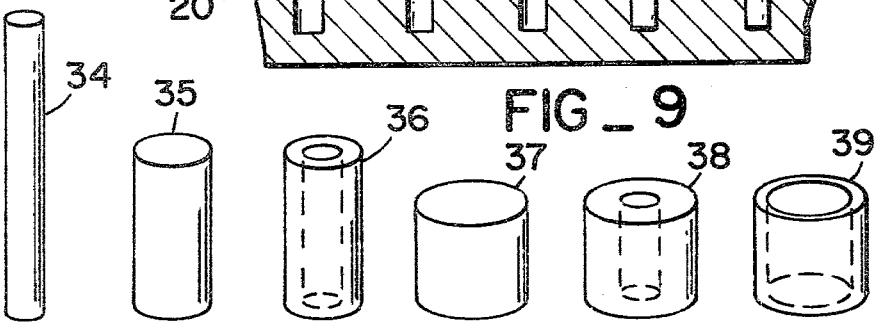

FIGS. 10*a* through 10*f* show the six different kinds of playing pieces used in combination with playing board 20 according to this embodiment of the invention. The first kind of playing piece is an elongated peg 34 shown in FIG. 10*a* having a cross-section dimensioned to be received within the hole 22 of a playing field 21 on the playing board 20. The second kind of playing piece is a plug 35 having a length less than the length of the peg 34 and a cross-section dimensioned to be received within the hole 23 of a playing field 21 of the playing board 20 as shown in FIG. 10*b*. FIG. 10*c* shows the third kind of playing piece which is an annular member or ring 36 having an external shape and dimensions substantially identical to those of the plug 35 but with a passageway extending axially therethrough to receive the peg 34.

As shown in FIG. 10*d*, the fourth kind of playing piece is a large plug 37 having a cross-section dimensioned to be received within the hole 24 of a playing field 21 of the playing board 20. The fifth and sixth kinds of playing pieces 38 and 39 shown in FIGS. 10*e* and 10*f*, respectively, have external shapes and dimensions substantially identical to those of the large plug 37. However, both are annular members or rings with playing piece 38 shown in FIG. 10*e* having a passageway therethrough with a cross-section dimensioned to receive the peg 34 freely therethrough, whereas the playing piece 39 shown in FIG. 10*f* has a passageway therethrough with a cross-section dimensioned to receive either the plug 35 of FIG. 10*b* or the ring 36 of FIG. 10*c*.

Figure 9:
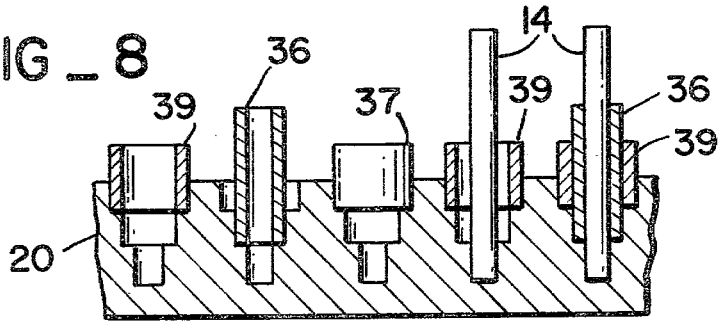
FIG. 9 is an enlarged fragmentary cross-sectional view similar to FIG. 8, showing a different combination of playing pieces in position on the playing board.

As shown in FIGS. 8 and 9, the six different kinds of playing pieces of FIG. 10 may be played either singly or in various combinations on the playing fields 21 of the playing board 20. The playing of the peg 34 on a given field 21 of the playing board 20 will block subsequent play on such field of the plug 35 and large plug 37 but will reserve that playing field for the subsequent play of the ring 36 and annular members 38 and 39. The initial play of a plug 35 at a given playing field 21 of the playing board 20 will block subsequent play of the peg 34, ring 36, large plug 37 and annular member 38 at such playing field but will reserve such playing field for the subsequent play of the annular member 39. The initial play of a ring 36 at a given playing field 21 of the playing board 20 will block subsequent play of the plug 35, large plug 37 and annular member 38 but will reserve such playing field for the subsequent play of the peg 34 and annular member 39.

The large plug 37 is the most powerful playing piece from the standpoint of blocking, since the initial play of the large plug 37 at any given playing field 21 of the playing board will block subsequent play of all other pieces at such playing field 21. The initial play of the annular member 38 at a given playing field 21 of the playing board 20 will reserve such playing field for subsequent play of the peg 34 but will block the subsequent play of all other playing pieces at such given playing field 21. The initial play of the annular member 39 at any given playing field 21 of the playing board will reserve such playing field for the subsequent play of the peg 34, plug 35 and ring 36 but will block subsequent play of the large plug 37 and annular member 38 at such playing field.

A game similar to that described in detail in connection with the embodiment of this invention shown in FIGS. 1 through 6 and 11 may be played using the game board and game pieces of FIGS. 7 through 10. However, it is believed that a wide variety of games may be devised for play with the game board 20 and playing pieces 34 through 39 described hereinabove, all of which games may take advantage of the interplay between the blocking and reserving functions of the playing pieces. The relative numbers of each kind of playing piece may be varied and less than all of the different kinds of playing pieces may be used in the playing of a particular game while still taking advantage of the unique interplay provided according to the teaching of this invention. The fact that the different kinds of playing pieces may be moved independently of each other adds a further dimension to the games which may be played according to this invention.

Although a playing board having playing fields comprising cylindrical holes and playing pieces which are cylindrical bodies are preferred, the holes may have any cross-sectional configuration dimensioned to receive the playing pieces and the playing pieces may have any cross-sectional configuration dimensioned to be received in the holes and to interact with each other in accordance with this invention. Thus, the playing pieces of a particular kind need not all have identical cross-sectional configurations although all of the holes in a particular playing board, if used, must be capable of receiving all of the playing pieces of each kind in accordance with the teaching of this invention.

Other aspects, objects and advantages of this invention may be discerned from a study of the drawing, the disclosure and the appended claims.

I claim:

1. In a game, the combination comprising:

(a) a plurality of first playing pieces each having a cross-sectional configuration of given maximum external dimension;

(b) a plurality of second playing pieces having an annular cross-sectional configuration dimensioned to surround said given maximum external dimension of the cross-sectional configuration of each of said plurality of first playing pieces when aligned therewith;

(c) a plurality of third playing pieces each having a cross-sectional configuration different from the cross-sectional configuration of said first and second playing pieces and each dimensioned to overlap said cross-sectional configurations of at least said plurality of said first playing pieces or said plurality of second playing pieces when aligned therewith; and (d) a playing board having a plurality of playing fields each comprising a first hole dimensioned to receive one of said plurality of first playing pieces, said first hole having a second hole countersunk therewith at one surface of said playing board and dimensioned to receive one of said plurality of second playing pieces;

whereby one of said plurality of first playing pieces and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field.

2. A combination as claimed in claim 1 wherein said first hole of each said playing field has a right circular cylindrical configuration of given diameter and said second hole of each said playing field has a right circular cylindrical configuration of given diameter.

3. A combination as claimed in claim 1 wherein said plurality of third playing pieces have a cross-sectional configuration dimensioned to overlap said cross-sectional configurations of both said plurality of first playing pieces and said plurality of second playing pieces.

4. A combination as claimed in claims 1 or 3 wherein each of said plurality of first playing pieces comprises a peg of given length, each of said plurality of second playing pieces and each of said plurality of third playing pieces having a common length less than said given length of said plurality of first playing pieces.

5. A combination as claimed in claim 2 wherein each of said plurality of first playing pieces comprises a peg of given axial length having a given solid circular cross-sectional configuration, each of said plurality of second playing pieces comprises an annular circular cylindrical body of given external diameter having a given axial length less than said given axial length of said first plurality of playing pieces and each of said plurality of third playing pieces comprises a solid circular cylindrical body having the same external diameter and axial length as said given external diameter and given axial length of each of said second plurality of playing pieces.

6. In a game, the combination comprising:

(a) a playing board having a plurality of playing fields;

(b) a plurality of first playing pieces each having a cross-sectional configuration of given maximum external dimension;

(c) a plurality of second playing pieces having an annular cross-sectional configuration dimensioned to surround said given maximum external dimension of the cross-sectional configuration of each of said plurality of first playing pieces when aligned therewith;

(d) a plurality of third playing pieces each having a cross-sectional configuration dimensioned to overlap said cross-sectional configurations of both said plurality of first playing pieces and said plurality of second playing pieces, whereby one of said plurality of first playing pieces and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field;

(e) a fourth playing piece having an annular cross-sectional configuration dimensioned to surround the cross-sectional configurations of each of said plurality of first playing pieces, said plurality of second playing pieces and said plurality of third playing pieces when aligned therewith; and (f) a fifth playing piece having an annular cross-sectional configuration dimensioned to surround said cross-sectional configurations of each of said first plurality of playing pieces when aligned therewith and to overlap said cross-sectional configurations of each of said plurality of second playing pieces, said plurality of third playing pieces and said fourth playing piece when aligned therewith.

7. a combination as claimed in claim 6 comprising:

(g) a sixth playing piece having a cross-sectional configuration dimensioned to overlap said cross-sectional configurations of each of said first plurality of playing pieces, said second plurality of playing pieces, said third plurality of playing pieces, said fourth playing piece and said fifth playing piece when aligned therewith.

8. In a game the combination comprising:

(a) a plurality of first playing pieces each having a cross-sectional configuration of given maximum external dimension;

(b) a plurality of second playing pieces each having an annular cross-sectional configuration dimensioned to surround said given maximum external dimension of the cross-sectional configuration of each of said plurality of first playing pieces when aligned therewith;

(c) a plurality of third playing pieces each having a cross-sectional configuration different from the cross-sectional configurations of said first and second playing pieces and each dimensioned to overlap said cross-sectional configurations of at least said plurality of said first playing pieces or said plurality of second playing pieces when aligned therewith;

(d) a playing board having a plurality of identical playing fields each adapted to receive any playing piece of said first, second and third pluralities of playing pieces, whereby one of said plurality of first playing pieces and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field; and (e) a fourth playing piece having an annular cross-sectional configuration dimensioned to be received on any of said plurality of identical playing fields of said playing board and to surround said cross-sectional configurations of each of said first playing pieces and each of said plurality of second playing pieces when aligned therewith and to overlap said cross-sectional configuration of each of said plurality of third playing pieces when aligned therewith.

9. In a game the combination comprising:

(a) a plurality of first playing pieces each having a cross-sectional configuration of given maximum external dimension;

(b) a plurality of second playing pieces each having an annular cross-sectional configuration dimensioned to surround said given maximum external dimension of the cross-sectional configuration of each of said plurality of first playing pieces when aligned therewith;

(c) a plurality of third playing pieces each having a cross-sectional configuration different from the cross-sectional configurations of said first and second playing pieces and each dimensioned to overlap said cross-sectional configurations of at least said plurality of said first playing pieces or said plurality of second playing pieces when aligned therewith;

(d) a playing board having a plurality of identical playing fields each adapted to receive any playing piece of said first, second and third pluralities of playing pieces, whereby one of said plurality of first playing pieces and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field; and (e) a fourth playing piece having an annular cross-sectional configuration dimensioned to be received on any of said plurality of identical playing fields of said playing board and to surround said cross-sectional configurations of each of said plurality of first playing pieces, said plurality of second playing pieces and said plurality of third playing pieces when aligned therewith.

10. In a game the combination comprising:

(a) a plurality of first playing pieces each having a cross-sectional configuration of given maximum external dimension;

(b) a plurality of second playing pieces each having an annular cross-sectional configuration dimensioned to surround said given maximum external dimension of the cross-sectional configuration of each of said plurality of first playing pieces when aligned therewith;

(c) a plurality of third playing pieces each having a cross-sectional configuration different from the cross-sectional configurations of said first and second playing pieces and each dimensioned to overlap said cross-sectional configurations of at least said plurality of said first playing pieces or said plurality of second playing pieces when aligned therewith;

(d) a playing board having a plurality of identical playing fields each adapted to receive any playing piece of said first, second and third pluralities of playing pieces, whereby one of said plurality of first playing pieces and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field; and (e) a fourth playing piece having a cross-sectional configuration dimensioned to be received on any of said plurality of identical playing fields of said playing board and to overlap said cross-sectional configurations of each of said plurality of first playing pieces, said plurality of second playing pieces and said plurality of third playing pieces when aligned therewith.

11. In a game the combination comprising:

(a) a plurality of first playing pieces each having a cross-sectional configuration of given maximum external dimension;

(b) a plurality of second playing pieces each having an annular cross-sectional configuration dimensioned to surround said given maximum external dimension of the cross-sectional configuration of each of said plurality of first playing pieces when aligned therewith;

(c) a plurality of third playing pieces each having a cross-sectional configuration different from the cross-sectional configurations of said first and second playing pieces and each dimensioned to overlap said cross-sectional configurations of at least said plurality of said first playing pieces or said plurality of second playing pieces when aligned therewith;

(d) a playing board having a plurality of identical playing fields each adapted to receive any playing piece of said first, second and third pluralities of playing pieces, whereby one of said plurality of first playing pieces and and one of said plurality of second playing pieces may be played simultaneously with each other at any one of said plurality of playing fields of said playing board with said second playing piece surrounding said first playing piece and each may be moved independently of the other to another playing field and whereby the playing of one of said plurality of third playing pieces at a given playing field of said playing board will physically block the playing of at least said plurality of first playing pieces or said plurality of second playing pieces at said given playing field; and (e) a fourth playing piece having an annular cross-sectional configuration dimensioned to be received on any of said plurality of identical playing fields of said playing board and to surround the cross-sectional configuration of each of said first plurality of playing pieces when aligned therewith and to overlap said cross-sectional configurations of each of said second plurality of playing pieces and each of said third plurality of playing pieces when aligned therewith.

12. A combination as claimed in claim 9 comprising a fifth playing piece having a cross-sectional configuration dimensioned to be received on any of said plurality of identical playing fields of said playing board and to overlap said cross-sectional configurations of each of said plurality of first playing pieces, said plurality of second playing pieces, said plurality of third playing pieces and said fourth playing piece when aligned therewith.

13. A combination as claimed in claim 8 or claim 10 comprising a fifth playing piece having an annular cross-sectional configuration dimensioned to be received on any of said plurality of identical playing fields of said playing board and to surround said cross-sectional configuration of each of said first plurality of playing pieces when aligned therewith and to overlap said cross-sectional configurations of each of said second plurality of playing pieces, said third plurality of playing pieces and said fourth playing piece when aligned therewith.

* * * * *